US005384964A

United States Patent [19]

McKay

[11] Patent Number: 5,384,964

[45] Date of Patent: Jan. 31, 1995

[54] ROTARY CIRCLE TEMPLATE

[76] Inventor: Dennis E. McKay, 239 Victoria Park Ave., Toronto, Ontario, Canada, M4E 3S4

[21] Appl. No.: 956,412

[22] Filed: Oct. 5, 1992

[51] Int. Cl.[6] ..... B43L 9/04

[52] U.S. Cl. ..... 33/27.03; 33/565

[58] Field of Search ..... 33/27.03, 565

[56] References Cited

U.S. PATENT DOCUMENTS

| | | | |
|---|---|---|---|
| 1,154,673 | 9/1915 | VanNess | 33/27.03 |
| 2,624,117 | 1/1953 | Paci | 33/27.03 |
| 2,958,132 | 11/1960 | Hartbauer et al. | 33/27.03 |
| 3,465,445 | 9/1969 | Fisher | 33/27.03 |
| 4,129,948 | 12/1978 | Hatter et al. | 33/27.03 |
| 4,530,156 | 7/1985 | Kettlestrings | 33/562 |
| 4,899,449 | 2/1990 | Fouladian | 33/565 |
| 5,125,161 | 6/1992 | Guthrie | 33/27.03 |

FOREIGN PATENT DOCUMENTS

| | | | |
|---|---|---|---|
| 0217974 | 4/1987 | European Pat. Off. | 33/27.03 |
| 3134890 | 3/1983 | Germany | 33/27.03 |

*Primary Examiner*—Thomas B. Will

*Attorney, Agent, or Firm*—Hodgson, Russ, Andrews, Woods & Goodyear

[57] ABSTRACT

A rotative drawing template, used to draw various sizes of circles. The template is circular in configuration and is held at its periphery by equally spaced balls running in between two bearing races; one located in the periphery of the template and the other race, located in the surrounding template support. This enables the template to freely rotate without lateral movements.

20 Claims, 3 Drawing Sheets

ROTARY CIRCLE TEMPLATE

BACKGROUND OF THE INVENTION

Templates are frequently used in design work for the drawing of circles. One type found in use is basically a thin flat plate with various sizes of circular holes manufactured into the plate; these holes corresponding to the sizes of circles that my be drawn. The template is moved over the drawing surface and positioned in the desired location so that a circle can be drawn.

Another form of circle template found in use, is the rotating circle template; which is essentially a thin flat plate that has a circular periphery. At the axis of this circular plate is a spring loaded pin with a conical point that when pushed into the drawing surface by finger pressure, allays the circular template to be rotated around the depressed pin. By placing the drawing means through any of the numerous eyelet sized holes manufactured in the template which are located progressively further from the central pin and rotating the said template as previously mentioned, the drawing means is guided in a circular path by the template so that a circle can be drawn on the drawing surface.

Both of the preceding templates mentioned, have a number of drawbacks. The first template mentioned carries a limited number of circles that can be drawn with one template. The cost of a full set of templates to produce a larger variety of circles is prohibitive. Another drawback presents itself if a designer wishes to draw circles in ink; there being the hazard of having the ink migrate between the template and the drawing surface thereby causing blotching on the said drawing surface. Still another drawback is seen when a plurality of concentric circles are drawn. Since the template must be repositioned for each new circle, concentricity is both difficult and time consuming.

The rotating circle template previously mentioned also has several drawbacks. For one; if ink is used to draw circles, blotching or smearing of the inked circle is possible due to the said circle template being rotated over the ink circle being drawn and thereby coming into contact with said circle. Furthermore, since a spring loaded pin is used under finger pressure, the designer using this template must maneuver the drawing means in one hand, around the other hand, which is being used to supply finger pressure to the spring loaded pin, thereby increasing the possibility of error by producing an unsatisfactory circle. Still a further drawback is caused due to the spring loaded pin covering over the axis of the circle being drawn. If the designer wishes to draw concentric circles at a later time from this position, there is great difficulty in finding the exact location where the spring loaded pin originally had been positioned into the drawing surface. Lastly, when using the said circle template to produce an arc tangential to converging right-angle lines, thereby forming a rounded corner on a drawing; this can only be accomplished by rotating the said template back and forth until the desired circle radius becomes tangential with said lines; this being time consuming and tedious.

SUMMARY OF THE INVENTION

It is the object of the present invention to overcome drawbacks found in a prior art such as those discussed above. Accordingly, a rotative circle template is provided with a support having a circular opening and several equally spaced balls of suitable material, which will run in between two bearing races; one race located on the periphery of the circle template and the other race located in the adjacent template support opening. Into this opening is placed the said template so that the equally spaced balls engage the template and its support in their bearing races,thereby allowing the template to be freely rotated with respect to said support without lateral movements. This design change will negate the need for an axial spring loaded pin as found on the prior art, discussed previously.

Included also on the present invention are two slots, equally bisecting each other to form a right-angled cross; the slots bisecting at the axis of the said rotative template and piercing through said template, thereby allowing the user to accurately and quickly position and or reposition the said template by eye, over any designated point produced on the drawing surface for the purpose of drawing circles therefrom. These crossed slots have tapered walls which narrow toward the drawing surface side of the rotative template. These said tapered slots thereby allow easier template positioning when sighting down the slots by eye.

Another movement offered by the present invention is the disposition of the said rotative template in the template support so that when the said invention is placed on the drawing and the template is rotated, said template does not touch the drawing surface, due to its suitable elevated disposition above the drawing surface. This prevents circle smearing or blotching when ink is used.

It is also the purpose of this new invention to facilitate the drawing of a wider range of circles between the smallest and the largest circle capability, as found on said template. The present invention will therefore have the ability to draw consecutive circles from the smallest to the largest circle capability as found on said template by having consecutively spaced, tapered eyelet sized holes no further apart from each other so as to allow each consecutive circle drawn to just touch its neighbouring circle, thereby leaving no gaps between said circles. The inwardly tapered eyelet holes allow for easier entry of the drawing means into said holes.

A still further object of the invention is to provide a quick and accurate means to round the corners produced by right-angled lines on drawings. The present invention quickly and accurately accomplishes this task. By referring to the drawing shown in FIG. 1; numeral 4 designates a symmetrically curved line manufactured on template 2. This line 4 reproduces the exact curve produced by the said symmetrically positioned eyelet holes 11 on said template 2, but in a 90 degree counterclockwise advanced position; therefore, this line represents the exact location on the drawing surface that any circle produced by the said rotative template, will pass over when the said template has been rotated 90 degrees in the counterclockwise direction; consequently by positioning and rotating said template so that the desired circle eyelet hole and curved line 4, are both simultaneously tangential over any desired right-angled line and by rotating said template in the counterclockwise direction, a 90 degree arc can be drawn that blend into both right angled lines, thus producing a rounded corner on said drawing; this without the need of rotating the said template back and forth in a trial and error fashion.

One other object of the present invention is to enhance the bottom face of the template support that rests against the drawing surface, with a suitable non slip surface manufactured into the said support surface that will not allow the present invention to slip out of position while the said template is being used. By applying slight downward pressure to the said template support, the non slip surface is pressed into the drawing surface, thereby locking it into place until the downward pressure is removed.

One further object of the invention is to negate ink blotching when using inking means in the supplied circle holes that are manufactured in the said template support. This is accomplished by supplimenting to the said circles in the support, an annular recess around each circle hole on the side of the template support that rests against the drawing surface. When an ink mean is used to draw circles, this annular recess will impede any ink migration between the drawing surface and said template support.

BRIEF DESCRIPTION OF THE DRAWINGS

Other objects and advantages of the invention will become more apparent from the specification taken in conjunction with the accompanying drawings, in which.

DESCRIPTION OF THE PREFERRED EMBODIMENT

Figure 1:
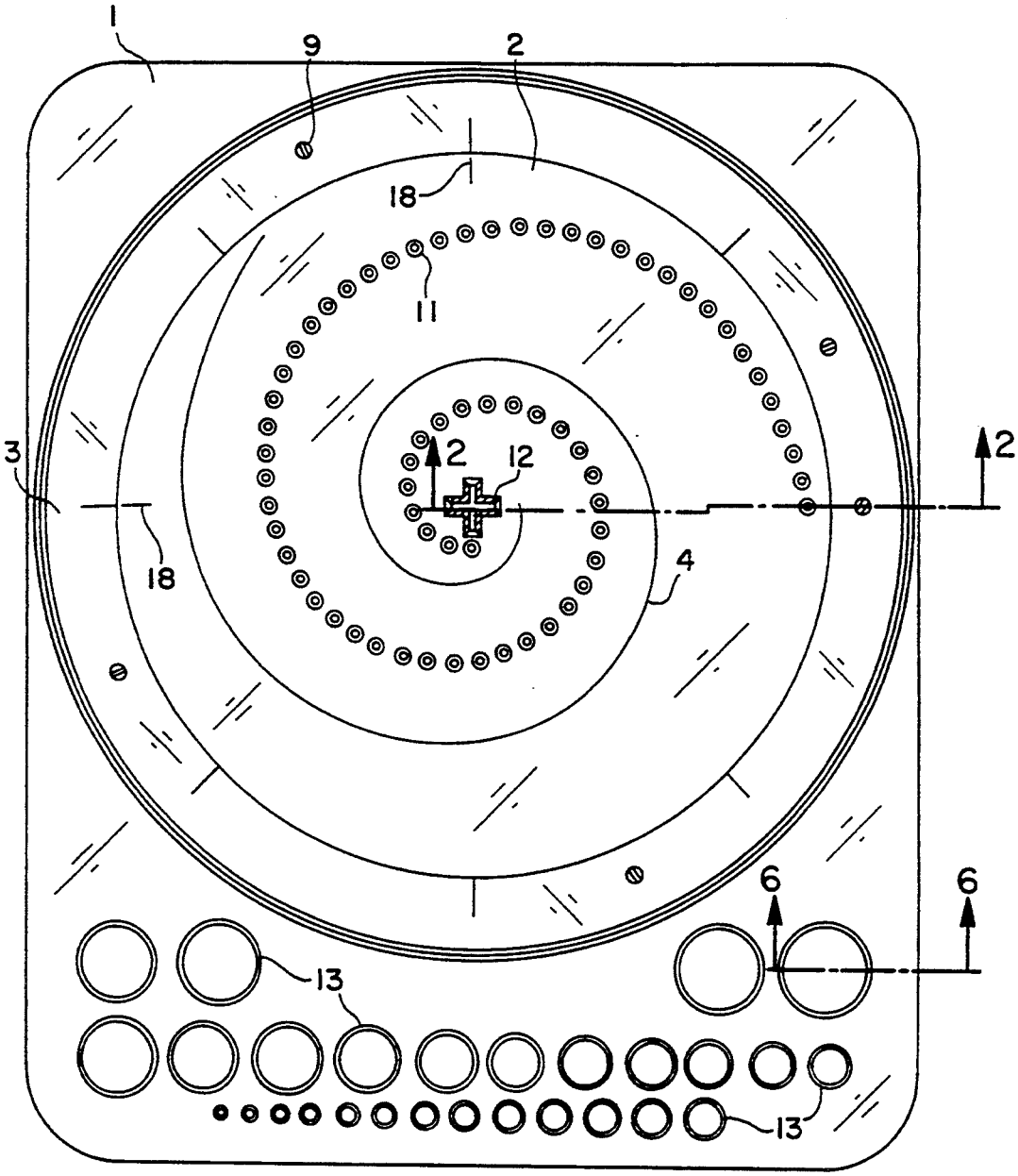
FIG. 1 is a plan view of the present rotary circle template positioned into its support, and having the circular protractor ring in place.

FIG. 1 shows a plan view of the assembled present invention, showing the noncircular support 1 which contains a circular opening, large enough to accept the circular template 2 and related bearing means 5 and 6. The circular protractor ring 3 is assembled and fastened into position by standard means 9. On the upper face of template 2 is found two markings 18, set 90 degrees apart from each other and used in conjunction with the protractor ring 3. Positioning slots 12 are located at the template axis. Found also on the under side of template 2 is the symmetrical line 4. The eyelet sized, circle holes 11 are found positioned in their respective configuration. On the template support 1, the supplimentary circle holes 13 are found positioned accordingly. It becomes apparent that the circular template and the template support will be made from a transparent material, such as a suitable thermoplastic. This of course, allows for the viewing of the drawing surface along with line 4, which is located on the bottom side of the template 2.

Figure 2:
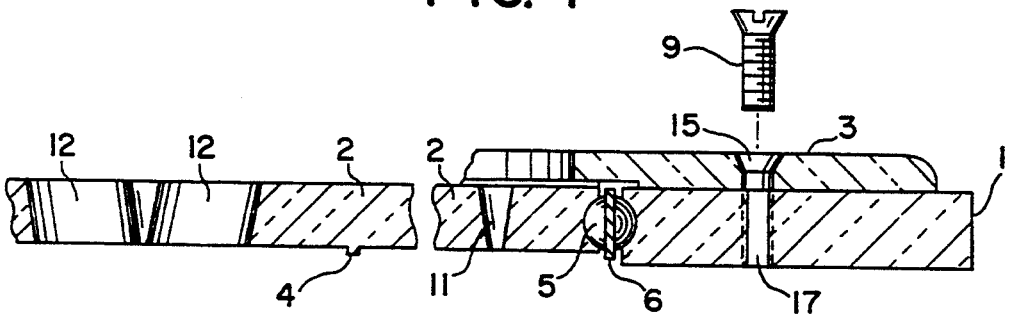
FIG. 2 illustrates a fragmentary section view of the circle template located in its support and having a fragmentary section view of the circular protractor ring in place.

FIG. 2 shows the fragmentary section views of support 1, circular template 2 and protractor ring 3. Also shown in section is the corresponding location of one of the roller balls 5 found situated in the bearing races of the circle template and adjacent support, along with the position of the annular ball spacer 6. The bottom side of the circle template is raised in relation to the bottom side of the support; thereby allowing the circular template to move over the drawing surface without touching it. Sectional views of the tapered eyelet hole 11; slots 12 with their tapered walls and the curved line 4, are shown respectively. The circular protractor ring 3, shown assembled in its location, has a recess 16, FIG. 4, manufactured into it, thereby allowing the circle template and the annular ball spacer to rotate freely without rubbing on said ring.

Figure 3:
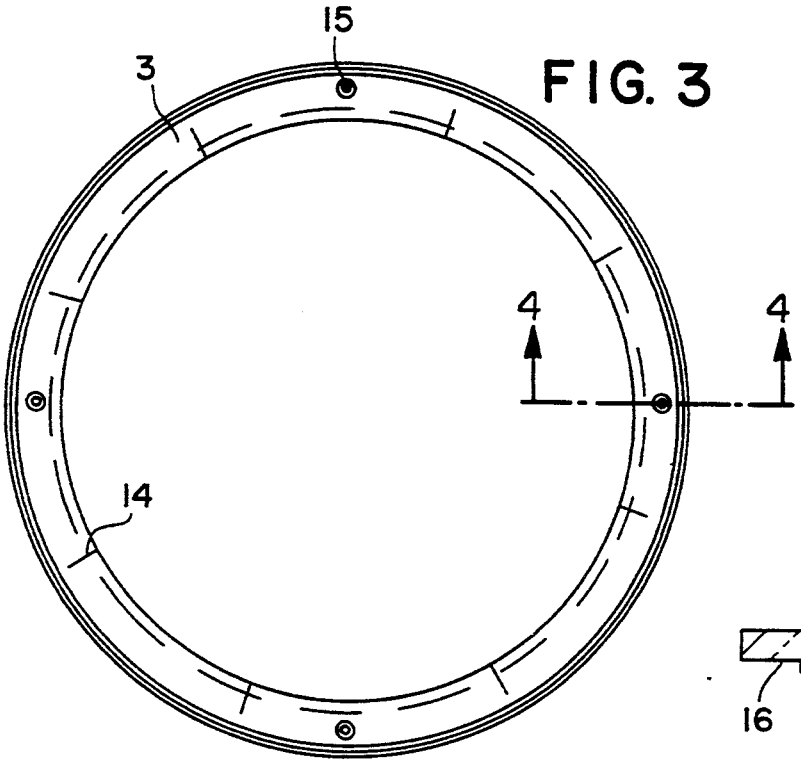
FIG. 3 illustrates a plan view of the circular protractor ring.

FIG. 3 shows the protractor ring 3 with its corresponding degree lines 14.

Figure 4:
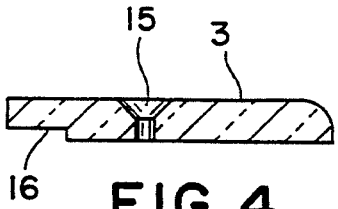
FIG. 4 illustrates a sectional view taken substantially along line 4—4 of FIG. 3.

FIG. 4 shows the protractor ring in section with fastening hole 15 and annular recess 16, that allows clearance for the template 2 and spacer ring 6.

Figure 5:
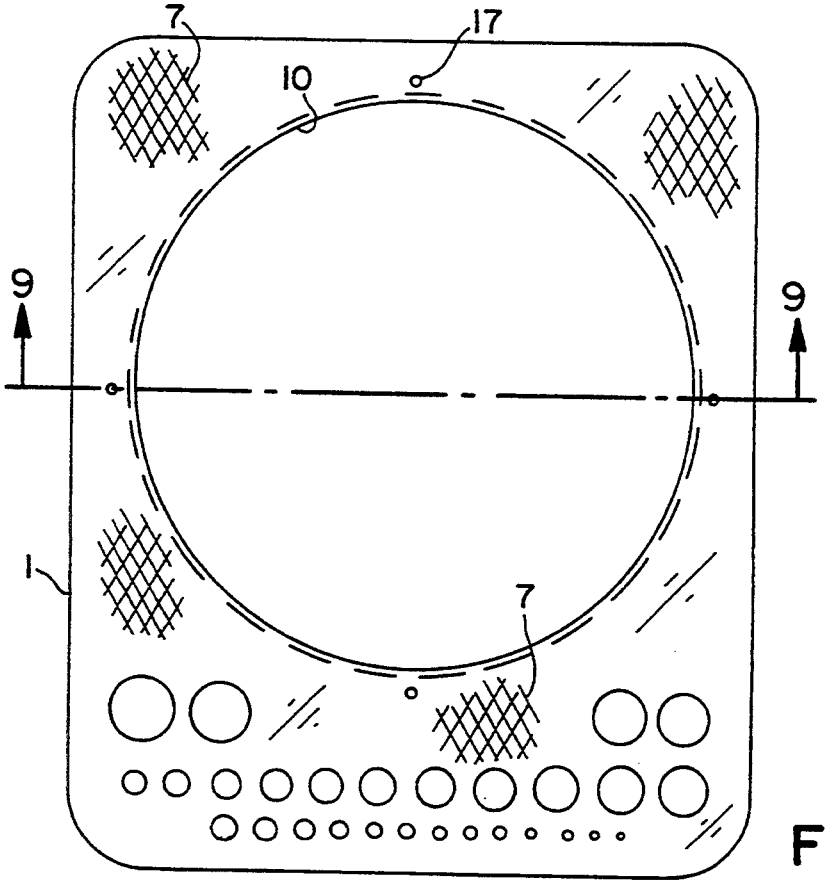
FIG. 5 illustrates the bottom view of the template support.

FIG. 5 shows the bottom view of the template support 1 with its circular opening 10 into which the circular template 2 and bearing means 5 and 6 are placed. The necessary surface area of this side has a suitable non slip means 7, manufactured into its surface.

Figure 6:
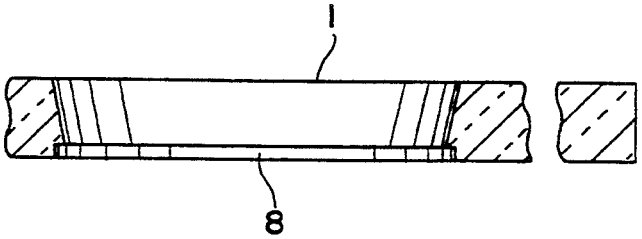
FIG. 6 illustrates a fragmentary sectional view taken substantially along line 6—6 of FIG. 1.

FIG. 6 shows a fragmentary section view of the typical circle holes 13, found in said support 1. The typical annular recess 8, is produced on the bottom side of the support.

Figure 7:
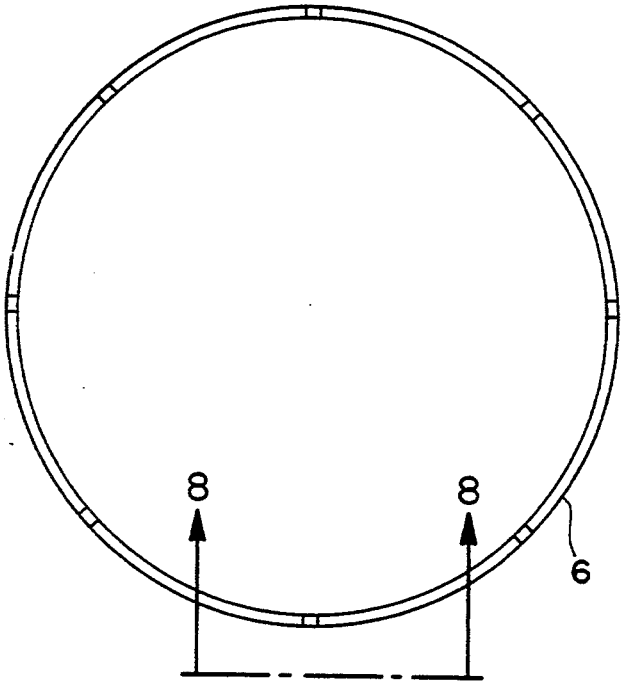
FIG. 7 illustrates a plan view of the annular spacer used to keep the bearing balls equally spaced around the periphery of the circle template and the template support at all times.

FIG. 7 is the annular spacer ring, showing the equally spaced keeper holes used for ball 5 positioning.

Figure 8:
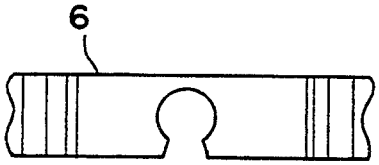
FIG. 8 illustrates a fragmentary sectional view taken substantially along line 8—8 of FIG. 7.

FIG. 8 indicates the configuration of the tapered slots, opening into the ball holes in the spacer ring 6. The slots are for assembly purposes, allowing the spacer ring to be snapped over the installed balls. This ring is made from a material which will allow for this without permanent deformation or breakage, such as a suitable thermoplastic.

Figure 9:
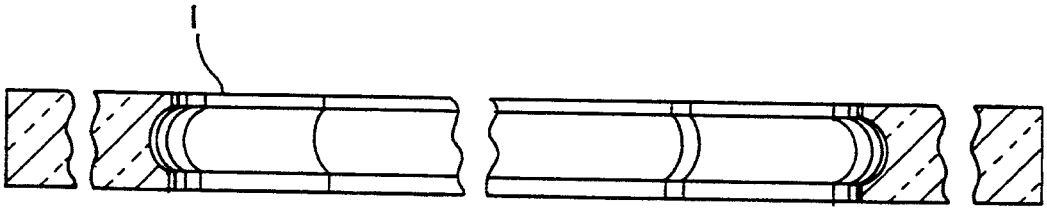
FIG. 9 illustrates a fragmentary sectional view taken substantially along line 9—9 of FIG. 5.

FIG. 9 is the fragmentary section view of the support 1, showing the bearing race located around the support opening 10.

The rotary circle template is assembled by placing the required number of balls 5, side by side into the support opening 10, and up against the bearing race. This allows the circular template 2, to be positioned into the support opening along with the balls, which can now be maneuvered with equal spacing around both bearing races, thereby taking up the lateral play between the circular template 2 and the support 1. With the balls in their respective positions around the bearing races, the annular spacer ring 6 can now be positioned so that each tapered slot on the spacer ring is directly over each ball, and snapped into position around the balls and between said circular template and its adjacent support as shown in FIG. 2. The protractor ring is now fastened into position by standard means 9.

The foregoing describes but one preferred embodiment of the present invention, other embodiments being possible without exceeding the scope thereof as defined in the following claims.

What is claimed is:

1. A circle drawing instrument comprising a flat noncircular shaped support having a circular opening therein that encompasses a ball race in said opening; a plurality of spherical rotatable ball means equally spaced by circumjacent placement around said ball race; a rotative circle template encompassed peripherally by a ball race and positioned in said support opening by said ball means locating into the template ball race; said template having an outside diameter dimension slightly less than said support opening for reception therein and within said ball means; said ball means surrounding and engaging the peripheral ball race of said template; said ball means further peripherally engaging said support opening ball race so as to negate lateral template movement, but allow for unhindered circular rotation of said template; the drawing instrument further comprising means to draw concentric, consecutively touching circles between the smallest and largest circle capability on said template which comprises: said rotative template having a plurality of eyelet sized holes, symmetrically curving outwardly from said rotative template axis; said holes being no further apart from their neighbouring holes, so as to allow drawing means entered into one eyelet hole after another and rotating the rotative template each time, to draw concentrical circles, each circle just touching said neighbouring circle; the drawing instrument further comprising means to quickly draw varying sizes of semi-circles that will blend from one line into a converging right-angled line, thereby producing a rounded junction, which comprises: said rotative template with a symmetrical line on bottom face of said rotative template and curving outwardly from said rotative template axis; said line reproducing the exact curved configuration of said positioned eyelet holes in said rotative template; said curved line positioned 90 degrees counterclockwise from said curved configuration of said eyelet holes.

2. The invention as described in claim 1 wherein means to negate drawing surface soiling due to rotative template contact thereon, comprises:

said rotative template being disposed into said support opening on a parallel, elevated plane above said drawing surface so as to totally avoid rotative template contact at all times with said drawing surface that said drawing instrument is situated upon.

3. The invention as described in claim 1 wherein means to position said rotative template over any designated point on said drawing surface comprises:

said rotative template having two straight slots of identical length, equally bisecting said rotative template axis and at right-angles to each other; said slots piercing through said rotative template with downwardly and inwardly tapered walls.

4. The invention as described in claim 1 wherein means for said invention to grip drawing surface when downward pressure is exerted upon said support face comprises:

said support bottom face having a nonslip surface manufactured into said face.

5. The invention as described in claim 1 wherein means to negate ink blotching on said drawing surface when using inking means in any supplimentary circle hole located in said template support, comprises:

said template support with said supplimentary circle holes, having an annular recess around each supplimentary circle hole; said annular recesses located only around said circle bases next to the drawing surface side of said support.

6. A drawing instrument comprising a flat support member, an inner circular edge portion defining a circular opening in said support member, a flat circle template member having a circular edge portion disposed within said circular opening, and means for rotating said circle template member relative to said support member, said rotating means comprising first ball race means in said support member edge portion, second ball race means in said template member edge portion, a plurality of spherical rotatable balls each receive in both said first and said second ball race means for effecting rotatable movement therebetween, a spacer ring including a plurality of spaced hole means for receiving said balls respectively, and means for snappingly receiving said bails within said hole means.

7. A drawing instrument according to claim 6 wherein said circle template member has an axis about which said circle template member is rotatable, the drawing instrument further comprising a plurality of hole means having centers for receiving a drawing device for cooperating with the drawing instrument for drawing concentric circles respectively, said hole means spaced circumferentially from adjacent ones of said hole means respectively in a spiral pattern wherein adjacent ones of said hole means overlap radially and said centers of said adjacent ones of said hole means are spaced apart radially.

8. A drawing instrument according to claim 7 wherein said circle template further includes means defining a line in a spiral pattern wherein each of said hole means centers is spaced from said axis a distance which is equal to a distance which a point on said line spaced 90 degrees circumferentially from said respective hole means is spaced from said axis.

9. A drawing instrument according to claim 6 wherein said circle template member has a lower surface and said support member has a lower surface which is below said circle template member lower surface whereby contact between said circle template member and a drawing surface may be avoided during drawing of circles with the drawing instrument.

10. A drawing instrument according to claim 6 wherein said circle template member has an axis about which said circle template member is rotatable, the drawing instrument further comprising means for aiding sighting for positioning of said axis over a designated point on a drawing surface, said sighting means comprising a pair of straight slot means extending entirely through said template at right angles to each other and intersecting each other at said axis.

11. A drawing instrument according to claim 6 wherein said support member had a bottom surface for contacting a drawing surface, the drawing instrument further comprising non-slip means on said bottom surface.

12. A drawing instrument according to claim 6 wherein said support member comprises a bottom surface for contacting a drawing surface, at least one circle hole means, and an annular recess means in said bottom surface around said circle hole means.

13. A drawing instrument according to claim 6 wherein said support member comprises an upper surface, the drawing instrument further comprising a circular protractor ring member including an outer portion fastened to said upper surface of said support member about said inner circular edge portion and including an inner portion having recess means defining a raised lower surface which overlies said first and second ball race means without contacting thereof.

14. A drawing instrument according to claim 6 wherein said snappingly receiving means comprises a plurality of tapered slot means which extent into said spacer ring and open into said hole means respectively, said slot means having a width which decreases with decreasing distance from said respective hole means.

15. A drawing instrument comprising a circle template member having an axis about which said circle template member is rotatable, means for supporting said circle template member for rotation thereof about said axis, a plurality of hole means having centers for receiving a drawing device for cooperation with the drawing instrument for drawing concentric circles respectively, said hole means spaced circumferentially from adjacent ones of said hole means respectively in a spiral pattern wherein adjacent ones of said hole means overlap radially and said centers of said adjacent ones of said hole means are spaced apart radially, said circle template member including means defining a line in a spiral pattern wherein each of said hole means centers is spaced from said axis a distance which is equal to a distance which a point on said line spaced 90 degrees circumferentially from said respective hole means is spaced from said axis.

16. A drawing instrument according to claim 15 wherein said circle template member has a bottom surface, said a line point is spaced 90 degrees circumferentially counterclockwise from said respective hole means, and said line is disposed on said bottom surface.

17. A drawing instrument according to claim 15 further comprising means for aiding sighting for positioning of said axis over a designated point on a drawing surface, said sighting means comprising a pair of straight slot means extending entirely through said circle template mender at right angles to each other and intersecting each other at said axis.

18. A drawing instrument according to claim 15 wherein said circle template member has a lower surface and said support member has a lower surface which is below said circle template member lower surface whereby contact between said circle template member and a drawing surface may be avoided during drawing of circles with the drawing instrument.

19. A drawing instrument comprising a circle template member having an axis about which said circle template member is rotatable, means for supporting said circle template member for rotation thereof about said axis, and means for aiding sighting for positioning of said axis over a designated point on a drawing surface, said sighting means comprising a pair of straight slot means extending entirely through said circle template member at right angles to each other and intersecting each other at said axis.

20. A drawing instrument according to claim 19 wherein said slots have identical lengths and have downwardly and inwardly tapered walls.

* * * * *